United States Patent [19]

Blackwood, et al.

[11] Patent Number: 4,725,249

[45] Date of Patent: Feb. 16, 1988

[54] CONNECTOR ASSEMBLY

[75] Inventors: Randall L. Blackwood, Noblesville; Leonard H. Drexler, Carmel, both of Ind.; William C. Hubner, Jr., West Long Branch, N.J.

[73] Assignees: American Telephone & Telegraph Company; AT&T Information Systems, both of Murray Hill, N.J.

[21] Appl. No.: 909,717

[22] Filed: Sep. 22, 1986

[51] Int. Cl.[4] ..... H01R 13/62

[52] U.S. Cl. ..... 439/535; 439/166

[58] Field of Search ..... 339/122 R, 123, 125 R, 339/31 R; 439/166, 518, 535, 536, 571

[56] References Cited

U.S. PATENT DOCUMENTS

| | | | |
|---|---|---|---|
| 2,934,590 | 4/1960 | Thompson et al. | 339/122 R X |
| 3,609,647 | 9/1971 | Castellano | 339/122 R |
| 4,273,957 | 6/1981 | Kolling | 339/122 R |
| 4,370,010 | 1/1983 | Ormandy | 339/31 |

*Primary Examiner*—Eugene F. Desmond

*Attorney, Agent, or Firm*—Harry L. Newman

[57] ABSTRACT

The connector assembly includes (1) a pair of connectors (300,300') for respectively terminating the individual conductors of a pair of multiconductor cables (200,200') and (2) a pair of adapters (500,600) that are respectively electrically connected to the connectors. The adapters come in different configurations and are user interchangeable to permit connection to external connectors having particular configurations.

8 Claims, 8 Drawing Figures

CONNECTOR ASSEMBLY

TECHNICAL FIELD

This invention relates to electrical connectors and more particularly to a connector assembly having user interchangeable adapters for making electrical connection with external connectors having differing configurations.

BACKGROUND OF THE INVENTION

In the field of communications, several standardized interfaces have been adopted for establishing electrical connection to communication lines. One such interface is the miniature jack, referred to as a modular jack, that has been adopted by the U.S. Federal Communications Commission as the standard connector for connecting telephone equipment to telephone lines. This jack, however, has a multiple of versions—a four contact version, a six contact version, and an eight contact version. Another such interface is a data jack introduced by the IBM Company as a token ring connector data jack.

With multiple standards like this, there is a problem in providing the appropriate interface at the location where the associated equipment is to be installed. This problem is increased when a building is prewired and preconnectorized in anticipation of the use of a variety of equipment. One solution is to provide the building with an array of each of the standard jacks at each potential equipment site. This is expensive and some of the jacks may never be used. Another solution is to make a best estimate of what particular piece of equipment will be used at each site and install only the associated interface at each site. While this is less expensive initially, if the estimate is in error, it is necessary to disconnect the jack from the conductors of the associated communication line and then connect the correct jack to these conductors. This change is not one that is easily done by the typical user. It, therefore, usually involves the use of a crafts person and thereby results in relatively large expense to the user.

SUMMARY OF THE INVENTION

A connector assembly in accordance with the present invention solves the above problem in a much more satisfactory manner by having user interchangeable adapters for making electrical connection with external connectors having differing configurations. The connector assembly comprises one or more connectors, each connector having elements for making electrical connection to a multiple of conductors at its rear end and a common electrical interface at its front end. Each adapter is associated with an individual connector and has an internal electrical interface at its rear end that is complementary to and makes electrical connection with the common internal electrical interface of the connectors. Each adapter further has a particular external electrical interface at its front end that is complimentary to and makes electrical connection with a particular external connector.

The connector assembly further comprises a frame for supporting the connectors at its rear end and the adapters at its front end. The frame includes first mounting elements at its rear end for securing the connectors in place. The frame further includes second mounting elements at its front end for mounting the adapters without the use of fasteners. The first and second mounting elements respectively locate an individual connector and an individual adapter for engagement of the internal electrical interface of the adapter with the common internal interface of the connector.

With the foregoing connector assembly, when there is a change in telephone or data equipment, a user no longer needs to replace the associated outlet. The user only needs to remove the existing adapter and replace it with the correct one.

DETAILED DESCRIPTION

Figure 1:
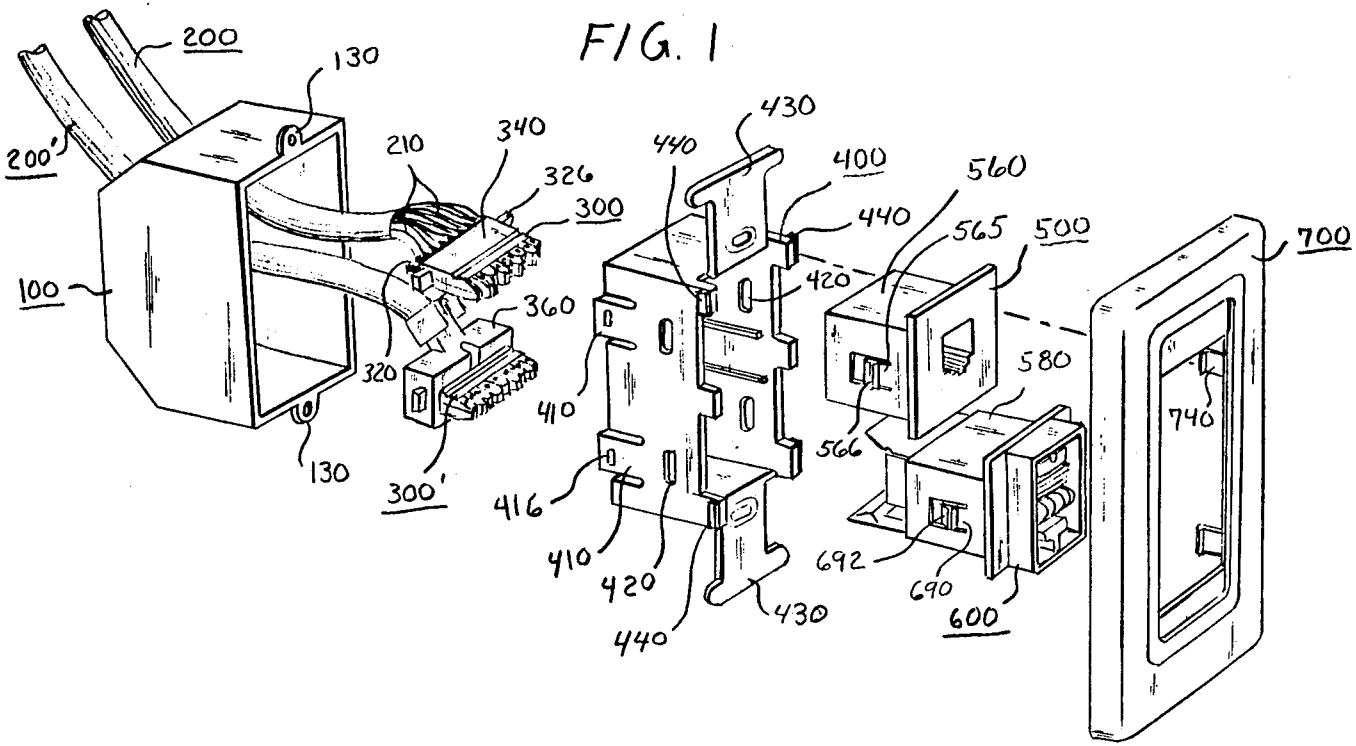
FIG. 1 is an exploded perspective view of a connector assembly in accordance with the present invention.

Referring to FIG. 1, a connector assembly in accordance with the present invention includes an outlet box 100 having openings (not shown) through which a pair of cables 200 and 200' having multiple insulated conductors 210 extend. The conductors 210 of the cables 200 and 200' are respectively electrically terminated by connectors 300 and 300' comprising an index strip 320 and a connecting block 340 of the type disclosed in U.S. Pat. No. 3,798,587.

Figure 2:
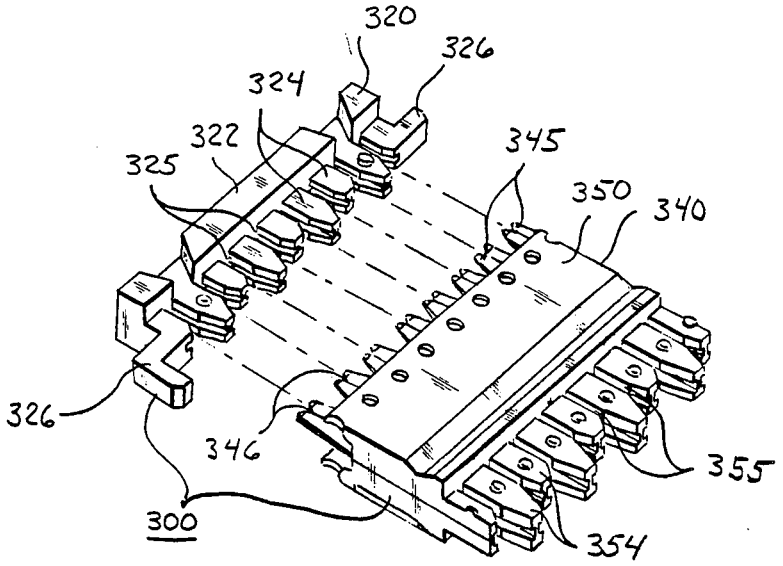
FIG. 2 is an exploded perspective view of a connector used in the connector assembly, the connector comprising an index strip used to arrange conductors of a cable in a linear array and a connecting block adapted to be secured to the index strip.

As shown most clearly in FIG. 2, the index strip 320 includes a base portion 322 from which a multiple of spaced pairs of opposed parallel extending teeth 324 extend. The forward ends of the teeth 324 are beveled to provide V-shaped entrances into slots 325 formed between adjacent pairs of teeth. Each slot 325 receives an individual insulated conductor 210, and as seen from FIG. 1, the insulated conductors 210 are thereby organized in a spaced linear arrangement. Each side of the index strip 320 has a shaped protrusion 326 extending from it, the function of which is described subsequently.

The connecting block 340 includes a multiple of generally symmetrical contacts 345 that have a bifurcated beam at each end (only the rear end being shown), each bifurcated beam having a conductor receiving slit 346. The contacts 345 are held in a spaced linear arrangement by a pair of mating dielectric elements that combine to form a support member 350. The spaced linear arrangement of the contacts 345 is essentially the same as that of the slots 325 in the index strip 320.

The rear end of the contacts 345 extend beyond the rear end of the support member 350, and the rear end of the support member has recesses formed therein (not shown) of a shape to accommodate the teeth 324 of the index strip 320. Thus the connector block 340 is adapted to be joined to the index strip 320, and when so joined, the bifurcated beams at the rear ends of the contacts 345 respectively extend into the slots 325 between the teeth 324 of the index strip. As a result, the insulated conductor held in each slot is forced into the slit 346 of the bifurcated beam extending into the slot. The bifurcated beam displaces the insulation from the conductor to make electrical connection to the conductor.

The front end of the support member 350 generally replicates the front end of the index strip 320 in that it also has a multiplicity of pairs of opposed parallel extending teeth 354. In addition, the front ends of the teeth 354 are beveled to provide V-shaped entrances into slots 355 formed between adjacent pairs of teeth. The connecting block 340 differs from the index strip 320 in that the bifurcated beams at the front ends of the contacts 345 are respectively located within the slots 355. Consequently, when the connecting block 340 is joined to the index strip 320 to form the connector 300, conductors pressed into the slots 355 are pressed into the slits of the bifurcated beams at the front end of the contacts 345 and thereby electrically connected to the conductors of the cables 200,200' (FIG. 1).

Referring again to FIG. 1, the cable 200' is shielded and therefore the connector block 300' is in turn provided with a shielding enclosure 360 that is connected to the shielding of the cable 200'. In addition, the connectors 300 and 300' are mounted on a frame 400 that is in turn mounted to the outlet box 100. The frame 400 comprises a hollow rectangular member, the sidewalls of which include opposed pairs of mounting elements to the rear and to the front. At the rear of the sidewalls, the mounting elements comprise two opposed pairs of flexible mounting portions 410 that are spaced vertically from one another. Only one flexible mounting portion 410 of each opposed pair is shown, but the flexible mounting portion that is not shown is the same as the one that is shown. More particularly, each flexible mounting portion 410 comprises a cantilever tab-like element, the fixed end of which is integral to its associated sidewall. Each flexible mounting portion 410 has an opening 416 extending through it adjacent to its free end.

The openings 416 in each opposed pair of flexible mounting portions 410 respectively accommodate the protrusions 326 (FIG. 2), which extend from the sides of the index strip 320, to secure the associated connector 300 or 300' to the frame 400. Opposed flexible mounting portions 410 are deflected away from one another as the protrusions 326 are moved into the openings 416, and then the mounting portions return to their normal undeflected positions when the protrusions are situated in the openings. The protrusions 326 advantageously differ in shape and the accommodating openings 416 have a corresponding shape. This assures that the connectors 300 and 300' are mounted on the frame 400 in the proper orientation. With the connectors 300 and 300' in place on the frame 400, the frame is secured to the outlet box 100 such as by threading fasteners (not shown) through holes in flanges 430 of the frame and into threaded holes in flanges 130 of the outlet box.

The mounting elements to the front of the sidewalls of the frame 400 comprises two opposed pairs of openings 420 that are spaced vertically from one another, each pair of openings being aligned with a pair of flexible mounting portions 410. The openings 420 serve to secure adaptors 500 and 600 to the frame 400.

Figure 3:
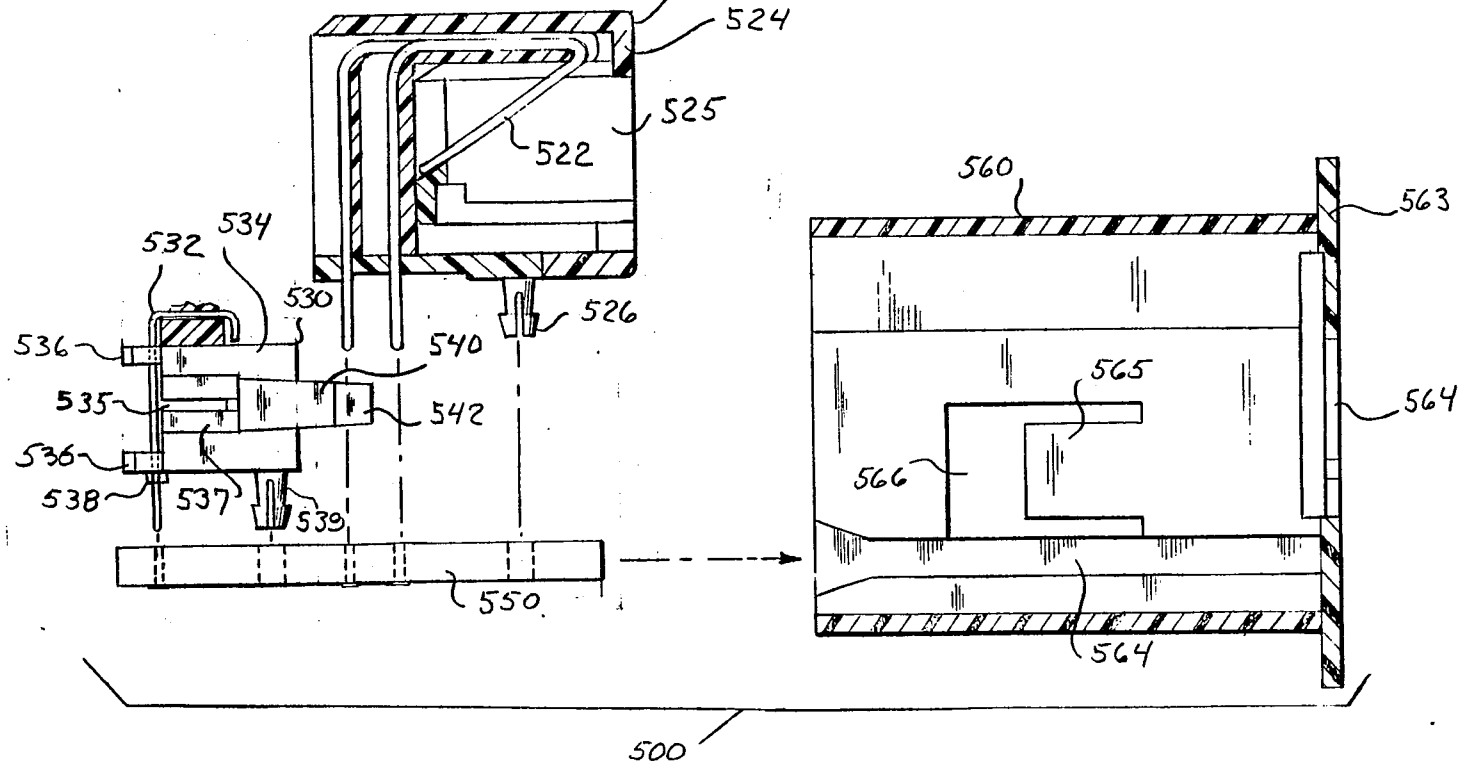
FIG. 3 is an exploded view partly in section of a first adaptor that may be used in the connector assembly, the view showing a pair of contact carrier assemblies and a base member separated from a housing within which the contact are normally positioned.

As shown most clearly in FIG. 3 the adaptor 500 comprises a pair of contact assemblies 520 and 530 mounted on a base member 550, the combination being positioned within housing 560. The contact assembly 520 is a female connector, referred to as a modular jack, that is of the type described in U.S. Pat. No. 3,850,497 and manufactured by AT&T under the designation 657E. The contact assembly 520 includes either 4, 6 or 8 wire spring contacts 522 (one of which is shown) that are mounted on a dielectric support member 524. The front end of the support member 524 includes a cavity 525 shaped to accommodate a complementary external connector (not shown), referred to as a modular plug, and one end of the wire spring contacts 522 extend cantilever fashion into this cavity. The other end of the contacts 522 wrap around the rear end of the support member 524 and extend below a bottom surface of the support member. In addition the support member 524 has a pair of split posts 526 (one of which is shown) that depend from its bottom surface.

Figure 4:
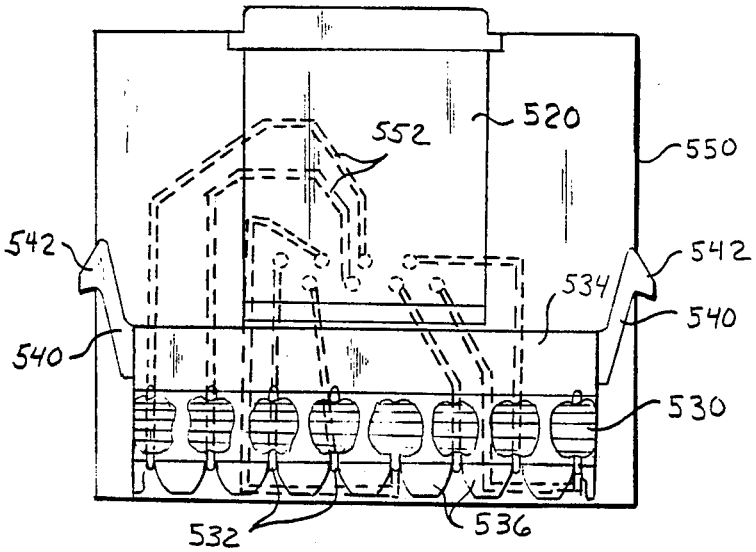
FIG. 4 is a top view of the contact carrier assemblies mounted on the base member.
Figure 5:
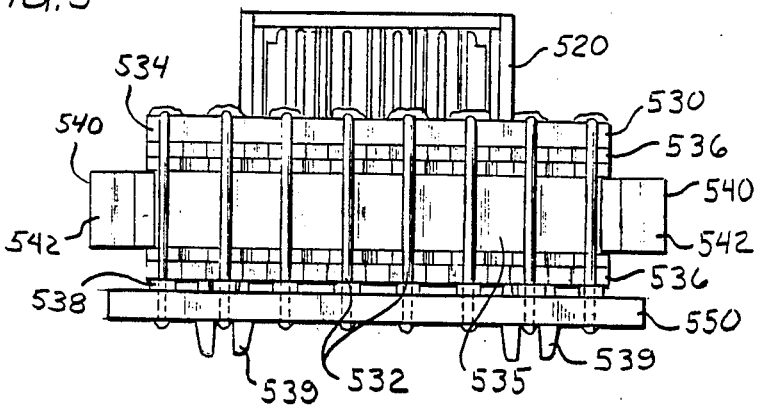
FIG. 5 is a rear view of the combination of FIG. 4.

Referring now also to FIGS. 4 and 5 the contact assembly 530 comprises a multiple of wire spring contacts 532 that are mounted on a dielectric support member 534. The rear end of the support member 534 includes a cavity 535 (FIG. 5) shaped to accommodate the teeth 354 (FIG. 2) of the associated connector 300. The wire spring contacts 532 are mounted so as to extend across the open rear end of the cavity 535 in the same spaced arrangement as that of the slots 355 (FIG. 2) between the teeth 354. Grooves in walls 536 above and below the cavity 535 serve to locate the contacts 532, while web portions 537 (FIG. 3) that respectively extend into the cavity in front of the contacts serve to support the contacts when the adaptor 500 is joined to the associated connector 300.

The upper ends of the contacts 532 are secured in place by ultrasonic forming of the support member 534 about them. The lower ends of the contacts 532 extend through holes (not shown) in bosses 538 depending from a bottom surface of the support member 534, the lower ends of the contacts extending for a distance below the bosses. The support member 534 also has a pair of split posts 539 that depend from its bottom surface. In addition, the support member 534 has a flexible cantilever mounting portion 540 that extends outwardly from each side, and each mounting portion has an outwardly facing protrusion 542 at its end.

As stated above, the contact assemblies 520 and 530 are mounted on a base member 550. The base member 550 comprises a printed circuit board having conductive paths 552 (FIG. 4) that electrically interconnect the contacts 522 of the contact assembly 520 with the contacts 532 of the contact assembly 530. The ends of the contacts 522 and 532 that respectively extend below the bottom surface of the support members 524 and 534 are accommodated by holes in the base member 550 and are soldered to the conductive paths. In addition, the split posts 526 and 539 of the support members 524 and 534 extend through holes in the base member 550 and physically secure the support members to the base member.

As shown most clearly in FIG. 4, except for the flexible mounting portions 540, the sides of the base member 550 extend beyond the sides of the support members 524 and 534, and this permits the sides of the base member to locate the above described combination within the housing 560. As seen from FIG. 3, sidewalls 562 of the housing 560 have grooves 564 (one of which is shown) formed in its internal surface, and these grooves accommodate the sides of the base member 550.

As the base member 550 and thereby the contact assemblies 520 and 530 are inserted into the housing 560, the flexible mounting portions 540 are deflected inwardly toward one another by the sidewalls 562 of the housing. The sidewalls 562 have opposed openings 566 therein, and the openings are located so that when the base member 550 is fully inserted into the housing 560, the protrusions 542 (FIG. 4) on the flexible mounting portions 540 extend into the openings to secure the contact assemblies 520 and 530 and base member 550 to the housing. In this fully inserted position, the front end of the support member 524 is positioned adjacent to a front wall 563 of the housing 560 that has an opening 564 that accommodates the complementary external connector.

Finally, the sidewalls 562 of the housing 560 have their own pair of opposed cantilever flexible mounting portions 565 that serve to secure the adaptor 500 to the frame 400. As seen from FIG. 1 where one of the flexible mounting portions 565 is shown, they each include an outwardly extending protrusion 566 at their free end. Guide rails on the inside surface of the sidewalls of the frame 400 locate the adaptor 500 within the frame, and as the adaptor is inserted into the frame, the flexible mounting portions 565 are deflected inwardly toward one another. Then when the adaptor 500 is fully inserted into the frame 400, the protrusions 566 move into the openings 420 in the sidewalls of the frame to secure the adaptor to the frame.

Figure 6:
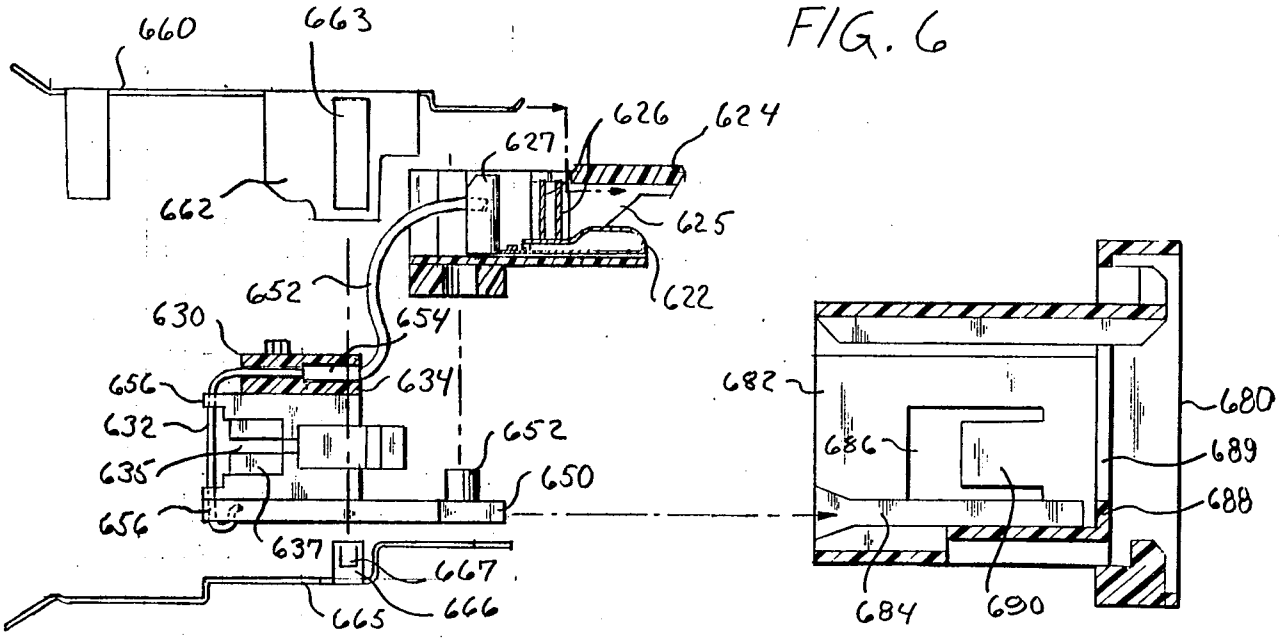
FIG. 6 is an exploded view partly in section of a second adaptor that may be used in the connector assembly, the view showing a pair of contact assemblies, a base member, and shielding members separated from a housing within which they are normally positioned.
Figure 7:
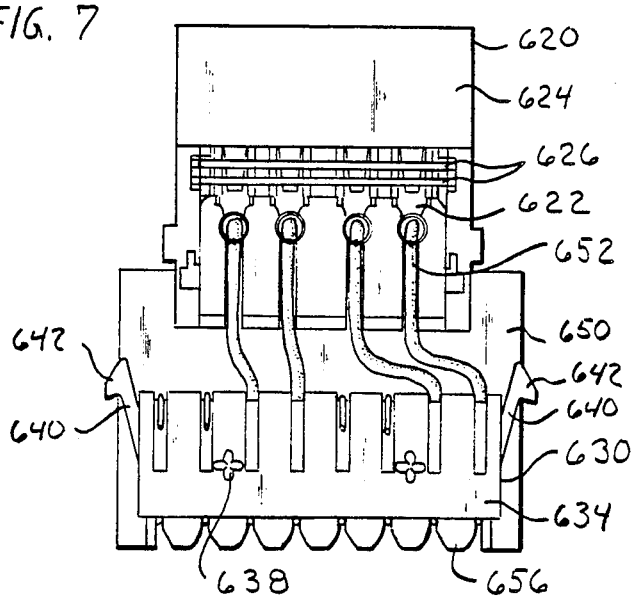
FIG. 7 is a top view of the contact carrier assemblies mounted on the base member.
Figure 8:
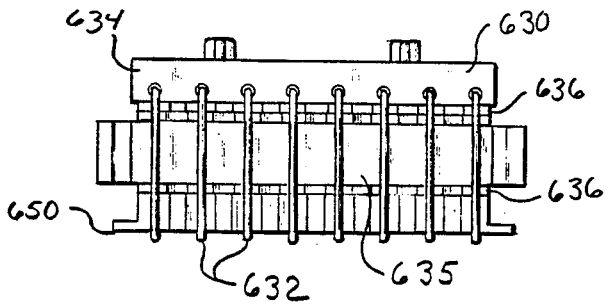
FIG. 8 is a rear view of the combination of FIG. 7.

Referring now to FIGS. 6, 7 and 8, the adaptor 600, while structurally different from the adaptor 500, is functionally very similar. The adapter 600 includes a pair of contact assemblies 620 and 630 and a base member 650. The adapter 600 also includes upper and lower electrically conductive shielding members 660 and 665. The combination of these elements is positioned within a housing 680.

The contact assembly 620 is an hermaphroditic connector in that it mates with an identical connector that is rotated 180 degrees. The contact assembly 620 includes a multiple of contact members 622 that are mounted on a dielectric support member 624. The front end of the support member 624 includes a cavity 625 for accommodating the external connector (not shown) and the front end of each contact member 622, which is a leaf spring contact that bends back over itself, extends into this cavity. When the front ends of the contact members 622 are not engaged by the associated contacts of the external connector, the free ends of the leaf spring contacts engage a pair of shorting bars 626. The rear end of each contact member 622 comprises an upwardly extending split barrel contact 627, and an insulated conductor 652 is electrically connected to selected ones of the contact members by being pressed down into the slit of its split barrel contact. The insulation is thereby displaced from the insulated conductor 652 to bring the conductor into engagement with the split barrel contact 627.

The contact assembly 630 comprises a multiple of wire spring contacts 632 that are mounted on a dielectric support member 634. The rear end of the support member 634 includes a cavity 635 shaped to accommodate the teeth 354 (FIG. 2) of the associated connector 300'. The wire spring contacts 632 are mounted so as to extend across the open rear end of the cavity 635 in the same spaced arrangement as that of the slots 355 (FIG. 2) between the teeth 354. Grooves in walls 636 above and below the cavity 635 serve to locate the contacts 632, while web portions 637 (FIG. 6) that respectively extend into the cavity in front of the contacts serve to support the contacts when the adapter 600 is joined to the associated connector 300'.

The upper ends of the contact 632 extend into horizontal holes in the upper portion of the support member 634 and selected ones of these ends are electrically connected to the insulated conductors 652 by conductive splicing members 654 (FIG. 6). Each splicing member 654 is crimped about both the end of the contact 632 and a bared end of the insulated conductor 652 to make the connection. The ends of the contacts 632 that are not connected to the conductor 652 are bent back over the top of the support member 634 as shown in FIG. 7. The lower ends of all of the contacts 632 are bent underneath the base member 650 which underlies and is integral to the support member 634.

As seen most clearly in FIG. 6, forward of the contact assembly 630, the base member 650 has a pair of upstanding posts 652 (one of which is shown) that are respectively accommodated by a pair of holes in the underside of the support member 624 of the contact assembly 620 to locate the contact assembly on the base member. The contact assembly 620 is held in place on the base member 650 by the latching of the upper shielding member 660 to the lower shielding member 670. The forward end of the upper shielding member 660 extends beneath the upper surface of the cavity 625 in the support member 624 of the contact assembly 620. The rearward end of the upper grounding member 660 extends over the upper surface of the support member 634 of the contact assembly 630 and has flanges 662 depending from its side edges, each of which have holes 663. Flanges 666, which are upstanding from the side edges of the lower shielding member 665 each have spring latches 667, and when the lower shielding member is properly positioned underneath the spring latches snap into the holes 663 in the flanges 662, bottom surface of the base member 650, As shown most clearly in FIG. 7, except for flexible mounting portions 640 that extend from the sides of the support member 634 and include outwardly basing protrusions 642, the sides of the base member 650 extend beyond the sides of the support members 624 and 634. This permits the sides of the base member 650 to locate the just described combination within the housing 680. As seen from FIG. 6, side walls 682 of the housing 680 have grooves 684 (one of which is shown) formed in its internal surface and these grooves accommodate the sides of the base member 650.

As the base member 650 and thereby the contact assemblies 620 and 630 are inserted into the housing 680, the flexible mounting portions 640 are deflected inwardly toward one another by the side walls 682 of the housing. The sidewalls 682 have opposed openings 686 therein and, the openings are located so that when the base member 650 is fully inserted into the housing 680, the protrusions 642 on the flexible mounting portion 640 extend into the openings to secure the combination of the contact assemblies 620 and 630, base member 650, and shielding members 660 and 670 to the housing. In this fully inserted position, the front end of the support member 624 is positioned adjacent to a front wall 688 of the housing 680 that has an opening 689 that accommodates the complimentary external connector.

Finally, the side walls 682 of the housing 680 have their own pair of opposed cantilever flexible mounting portions 690 that serve to secure the adapter 600 to the frame 400. As seen from FIG. 1 where one of the flexible mounting portion 690 is shown, that each include an outwardly extending protrusion 692 at their free end. Guide rails on the inside surface of the sidewalls of the frame 400 locate the adapter 600 within the frame, and as the adapter is inserted into the frame, the flexible mounting portions 690 are deflected inwardly toward one another. When the adapter 600 is fully inserted into the frame 400, the protrusions 692 move into the openings 420 in the side walls of the frame to secure the adapter to the frame. In this position, the wire spring contacts 632 of the contact assembly 630 are in engagement with the contacts of the connector 300'. In addition, the rear ends of the shielding members 660 and 665 are in engagement with the shielding enclosure 360 disposed about connector 300'.

The connector assembly is completed by the snap mounting of the face plate 700 to the frame 400. This is accomplished by wedged-shaped bosses 440 located at the forward four corners of the frame 400 which are engaged by flexible fingers 740 extending rearwardly from the rear surface of the face plate 700. Thus the face plate 700 is mounted on or removed from the front of the frame 400 without the need for any tools. When the face plate 700 is removed, end of the adapters 500 or 600 may be removed by deflecting the flexible mounting portions 590,690 of the housings 560,680 inwardly to withdraw their protrusions 592,692 from the associated openings 420 and pulling forward on the adapter.

What is claimed is:

1. A connector assembly having user interchangeable adapters for making electrical connection with external connectors having differing configurations, the connector assemby comprising:

multiple connectors, each connector having elements for making electrical connection to a multiplicity of conductors at its rear end and a common internal electrical interface at its front end;

multiple adapters, each adapter being associated with an individual connector and having an internal electrical interface at its rear end that is complementary to and makes electrical connection with the common internal electrical interface of the connectors, each adapter further having a particular external electrical interface at its front end that is complementary to and makes electrical connection with an associated external connector; and a frame for mounting within an outlet box and for supporting the multiple connectors at its rear end and the multiple adapters at its front end, the frame including first mounting elements at its rear end for securing the multiple connectors in place without the use of fasteners, the frame further including second mounting elements at its front end for mounting the multiple adapters without the use of fasteners, the first and second mounting elements respectively locating an individual connector and an individual adapter for engagement of the internal electrical interface of the adapter with the common internal interface of the connector.

2. A connector assembly having user interchangeable adapters for making electrical connection with external connectors having differing configurations, the connector assembly comprising:

one or more connectors, each connector having elements for making electrical connection to a multiplicity of conductors at its rear end and a common internal electrical interface at its front end;

one or more adapters, each adapter being associated with an individual connector and having an internal electrical interface at its rear end that is complementary to and makes electrical connection with the common internal electrical interface of the connectors, each adapter further having a particular external electrical interface at its front end that is complementary to and makes electrical connection with an associated external connector; and a frame for supporting the connectors at its rear end and the adapters at its front end, the frame including first mounting elements at its rear end for securing the connectors in place, the first mounting elements of the frame comprising a pair of flexible mounting portions for securing each connector in place without the use of fasteners, the flexible mounting portions being deflectable to mount the connector on and remove the connector from the frame, the frame further including second mounting elements at its front end for mounting the adapters without the use of fasteners, the first and second mounting elements respectively locating an individual connector and an individual adapter for engagement of the internal electrical interface of the adapter with the common internal interface of the connector.

3. A connector assembly as in claim 2 wherein each flexible mounting portion of the frame includes an openings and the sides of each connector include opposite extending protrusions that are accommodated by the openings in the flexible mounting portions when the connector is secured to the frame.

4. A connector assembly as in claim 2 wherein the second mounting elements of the frame comprise a pair of openings for securing each adaptor in place without the use of fasteners, each pair of openings being aligned with the associated pair of flexible mounting portions of the frame and each adaptor including a pair of flexible mounting portions having protrusions that are accommodated by the openings when the adaptor is secured to the frame.

5. A connector assembly having user interchangeable adapters for making electrical connection with external connectors having differing configurations, the connector assembly comprising:

one or more connectors, each connector having elements for making electrical connection to a multiplicity of conductors at its rear end and a common internal electrical interface at its front end;

one or more adapters, each adapter being associated with an individual connector and having an internal electrical interface at its rear end that is complementary to and makes electrical connection with the common internal electrical interface of the connectors, each adapter further having a particular external electrical interface at its front end that is complementary to and makes electrical connection with an associated external connector, each adapter comprising a first contact assembly including a support member on which is supported a multiple of contacts that provide the internal electrical interface that is complementary to and make electrical connection with the common internal electrical interface of the connectors;

a second contact assembly comprising a support member on which is supported a multiple of contacts that provide the internal electrical interface that is complementary to the associated external connector, the contacts of the first and second assemblies being electrically interconnected;

a planar base member on which the first and second contact assemblies are mounted, the sides of the base member extending laterally; and a hollow housing within which the first and second contact assemblies are positioned, the housing having a pair of opposed sidewalls having grooves formed in interior surfaces thereof that accommodate the sides of the base member, the contacts of the first assembly being located at the rear of the housing and the contacts of the second contact assembly being located at the front of the housing.

6. A connector assembly as in claim 5 wherein each side of the housing has an opening therein and the support member of the first contact assembly includes a pair of flexible mounting portions having protrusions that are accommodated by the openings in the sides of the housing to secure the first and second contact assemblies and the base member to the housing.

7. A connector assembly as in claim 5 wherein the contacts that provide the internal electrical interface of the adaptors comprise a linear array of uniformly spaced wire contacts that are mounted on the support member of the first contact assembly so as to extend in a generally vertical direction.

8. A connector assembly as in claim 7 wherein the common internal electrical interface of the connectors comprise a linear array of uniformly spaced contacts positioned within slots in the connectors that accommodate the wire contacts of the adaptors.

* * * * *